US005535836A

United States Patent [19]

Cagianut et al.

[11] Patent Number: 5,535,836

[45] Date of Patent: Jul. 16, 1996

[54] TOTAL RECOVERY DRILL

[75] Inventors: Joseph A. Cagianut, Oakview; Joseph J. Bentley, Ventura; Christopher J. Penza, Camarillo, all of Calif.

[73] Assignee: Ventura Petroleum Services , Inc., Ventura, Calif.

[21] Appl. No.: 249,151

[22] Filed: May 25, 1994

[51] Int. Cl.[6] ..... E21B 21/00; E02D 5/18

[52] U.S. Cl. ..... 175/213; 175/424; 166/222; 405/269

[58] Field of Search ..... 166/222, 311; 175/315, 213, 215, 320, 424; 405/128, 269

[56] References Cited

U.S. PATENT DOCUMENTS

| | | | |
|---|---|---|---|
| 1,994,884 | 3/1935 | Chew | 255/1 |
| 2,113,968 | 4/1938 | Thrift | 255/72 |
| 2,678,203 | 5/1954 | Huff | 175/213 |
| 2,720,381 | 10/1955 | Quick | 175/424 X |
| 3,638,741 | 2/1972 | Zizak | 175/215 |
| 4,119,160 | 10/1978 | Summers et al. | 175/424 |
| 4,369,850 | 1/1983 | Barker | 175/393 |
| 4,640,649 | 2/1987 | Nakanishi | 405/237 |
| 4,823,888 | 4/1989 | Smet | 175/45 |
| 4,936,059 | 6/1990 | Hashish et al. | 51/439 |
| 5,061,119 | 10/1991 | Balthaus et al. | 405/128 |
| 5,069,725 | 12/1991 | Fischer et al. | 134/42 |
| 5,116,163 | 5/1992 | Bernhardt | 405/128 |
| 5,174,394 | 12/1992 | Fischer et al. | 175/315 |
| B1 4,369,850 | 7/1988 | Barker | 175/393 |

*Primary Examiner*—Frank Tsay
*Attorney, Agent, or Firm*—Presseisen & Reidelbach

[57] ABSTRACT

A total recovery drill assembly for providing a flowable cutting material discharging from a multiple orifice nozzle with the nozzle rotating around the longitudinal axis of the drill is provided herein. This assembly includes an outer tube that is connected to a vacuum source on a proximal end and terminates with grooves on the distal end. Within the outer tube is an inner tube that rotates within the outer tube. The proximal end of the inner tube is connected to a high pressure source for discharging a flowable material that is either a gas, a liquid or a particulate solid. The distal end of the inner tube is connected to a nozzle. The nozzle has a cutting orifice and an agitating orifice. The cutting orifice discharges the flowable material towards the grooves of the outer tube. Drilling is achieved by aiming the discharged flowable material as a laminar flow. Additionally, the nozzle has an agitating orifice designed to agitate the cut substance for removal by the vacuum. In an alternative embodiment, the drill has a second nozzle similarly designed and discharging either the same or different material.

25 Claims, 4 Drawing Sheets

TOTAL RECOVERY DRILL

FIELD OF THE INVENTION

This invention relates to a drilling method and apparatus. Specifically, this invention relates to drills which employ a pressurized flowable material to achieve cutting. More specifically, this invention relates to drills which recover all of the substance that was drilled.

BACKGROUND OF THE INVENTION

Drilling systems which use a pressurized stream of air or liquid are well known in the art. Typically, these systems employ a stream of air or water that is discharged from a high pressure lance. These systems operate in the low pressure ranges, i.e. 100–200 psi., to cut through earthen soil or soft materials. Often, these systems are used to excavate holes and are simple in operation. The operator merely aims the lance and activates the pressure supply to discharge the air or water. The hole is created as the air or water pushes away the soil. There are other systems that also provide a method and apparatus to recover the loosened soil. Two similar methods and devices which recover the loosened soil are described in literature published by the Miller Pipeline Corporation of Long Beach, Calif. and SoftDig Corporation of West Chester, Pa.

Both the Miller and the SoftDig techniques require a two person crew to operate their respective high pressure drilling devices. In this two person crew arrangement, the first crew member aims the high pressure air lance towards the soil which is to be loosened. The second crew member operates a separate vacuum line near the position where the high pressure air lance is performing the cutting. When activated, the vacuum line recovers the loosened soil.

These systems have the initial drawback that they require two crew members to operate. Additionally, these devices are directed at excavating soil for the purpose of exposing utility lines. The device and method disclosed by Miller and SoftDig are intended to effectuate the drilling process without damaging the utility lines. In operation, because the air lance and vacuum lines are not integrated, the drilled soil is not entirely contained by the vacuum line, resulting in a dust discharge from the excavated hole. Thus, Miller and SoftDig are not directed towards a drilling apparatus and a drilling method that recovers all of the loosened soil which was drilled.

Additionally, there are also drilling systems which use a flowable particulate solid, like sand. Sand blasting is one technique that uses sand to strip away a surface layer of an object. However, sand blasting, generally, is intended to reveal the inner portion of the object and is not directed at recovering the material that was stripped away.

It is accordingly, an object of the present invention to provide a drill which is capable of employing a pressurized gas, liquid, or particulate solid to achieve the drilling.

It is another object of the present invention is to provide a drill which recovers all of the material that was drilled.

Yet another object of the present invention is to provide a drill which can be used by a single operator.

Still another object of the present invention is to provide an improved drill which is simple in construction, economical to manufacture, and simple, efficient, and safe to use.

SUMMARY OF THE INVENTION

In accordance with the present invention, a drill is provided that includes a housing and a pair of tubes, one tube within the other. The distal end of the outer tube, relative to the housing, makes contact with the material to be drilled. This material is typically, although not limited to, earthen soil, dirt, and the like. Additionally, harder substances, like sand stone and cement, can be drilled by the present invention.

At a location near the proximal end of the outer tube, a vacuum source is connected to remove the soil, once the soil has been drilled. The inner tube is disposed within the outer tube and terminates at a distal end short of the distal end of the outer tube. At the proximal end of the inner tube, a pressure source is provided.

The pressure source provides a flowable material at predetermined pressure. The flowable material can be either a gas, liquid or a particulate solid, such as but not limited to sand. A nozzle is provided at the distal end of the inner tube for directing the flowable material towards the soil. The nozzle has a first channel terminating at a first orifice and a second channel terminating at a second orifice, each for discharging the flowable material.

The first orifice is substantially directed at the distal end of the outer tube. In operation, the flowable material that is discharged from the first orifice makes contact with the soil located near the distal end of the outer tube, cutting the soil. In order to achieve a uniform cut around the interior circumference of the outer tube, the inner tube can rotate within the outer tube, along the interior circumference of the outer tube. Alternatively, the inner tube is connected to the outer tube and the outer tube rotates about its longitudinal axis. In either embodiment, the first orifice remains aimed at the distal end of the outer tube during rotation. Thus, as the drill is being operated, the drill will advance through a hole, either by virtue of the drill's weight or by an applied force.

The second orifice is substantially directed towards the longitudinal axis of the outer tube. In operation, flowable material that is discharged from the second orifice agitates the soil previously cut by the flowable material discharged by the first orifice so that the cut soil remains in a loosened state. As the drill advances through the hole, the cut soil is kept within the outer tube. When rotating, the second orifice remain aimed at the longitudinal axis of the outer tube. The vacuum existing within the outer tube removes all the loosened soil and the discharged flowable material.

Additionally, the two respective channels that terminate at the first orifice and the second orifice are of a length adequate to guaranty that the pressure exerted by the flowable material exiting the two orifices is substantially free from turbulence.

It is a feature of the present invention that the interaction of the first orifice and the second orifice provide a technique to drill soil and to recover all drilled soil. An additional feature is that the drill may be operated by one person.

Thus, it is an advantage of the present invention that the drill can be used to drill soil that contains contaminants, such as hazardous materials, where other drilling techniques would present the potential of further spreading the contaminated soil. Often, the drilling of contaminated areas is highly regulated by statute and recovering all the soil which is drilled is a legal requirement. Therefore, preventing spillage of the contaminated soil is a controlling factor in the choice of drilling techniques. Clearly, as applied to the handling of hazardous materials, the integration of the inner tube with a cutting nozzle within an outer tube having a vacuum therein is essential for the present invention.

Additionally, the present invention is useful where the soil contains a highly valuable substance in a granulated form, such as precious metal. The present invention allows drilling with the ability to recover all the soil for processing of the valuable material. Thus, this drill would be successful in conjunction with strip mining.

Furthermore, the present invention is to remove soil surrounding utility lines without damaging the utility lines.

These and other features and objects of the present invention will be apparent to those skilled in the art from the following detailed description, taken together with the accompanying drawings, in which:

DESCRIPTION OF THE PREFERRED EMBODIMENTS

Figure 1:
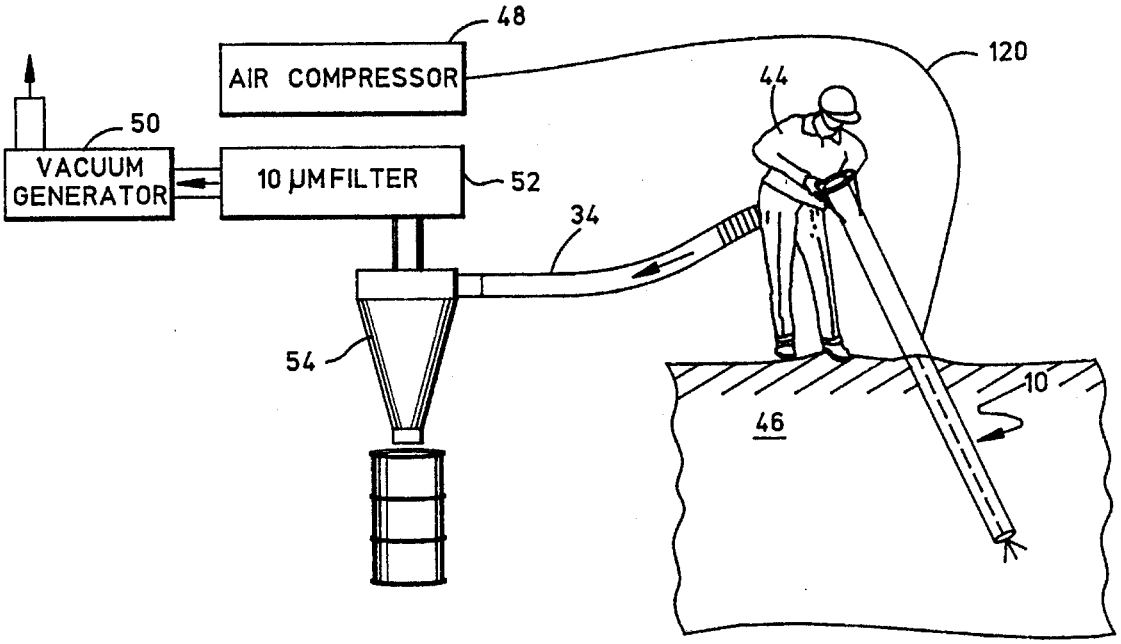
FIG. 1 is a view of the present invention being used in a typical environment.

Referring the FIG. 1, the present invention is generally designated by the numeral 10. In FIG. 1, the drill 10 is shown in a typical environment. In this application, the operator 44 is using the drill 10 to remove contaminated soil 46. In this specific example, an air compressor 48 is supplying pressurized air as the flowable material through the high pressure line 120. The air is discharged at the distal end of the drill 10, relative to the operator 44. At the distal end, the drill 10 cuts and loosens the contaminated soil 46.

A vacuum generator 50 provides the necessary suction to recover the cut contaminated soil 46. The contaminated soil 46 is recovered through vacuum line 34, which is indirectly connected to the vacuum generator 50 through a cyclone separator 54 and a 10 micrometer filter 52. Although not central to the present invention, those skilled in the art will recognize that the operation of the air compressor 48 and the vacuum generator 50 could be combined into a singular device (not shown). The use of the air compressor 48 and the vacuum generator 50 in this typical environment is merely illustrative and should not serve to limit the scope of the invention. Also, it should be evident to those skilled in the art that the air compressor 48 could be replaced by a water pump or sand blasting apparatus to provide different flowable material for drilling.

Returning now to the illustrated use of the present invention, as shown in FIG. 1, because this particular use of the drill 10 is to recover contaminated soil 46, the 10 micrometer filter 52 is connected between the vacuum generator 50 and the vacuum line 34 to prevent any of the contaminated soil 46 from entering the vacuum generator 50. The cyclone separator 54, or any suitable collection device, is attached between the filter 52 and the vacuum line 34, to collect the recovered contaminated soil.

It should be understood that recovery of contaminated soil 46 is only but one particular use for the present invention. The drill 10 is conceived and designed for any environment where the recovery of all drilled material is controlling the choice of drilling techniques. Another environment where the present invention may be effectively used, among potentially many others, is strip mining for precious metals or precious substances. Additionally, this drill is capable of operation in an underwater environment for recovery of valuable or contaminated substances existing in soil or rocks which are beneath the floor of the water body. Furthermore, this drill is capable of removing the material surrounding a utility line without damaging the utility line.

Figure 2:
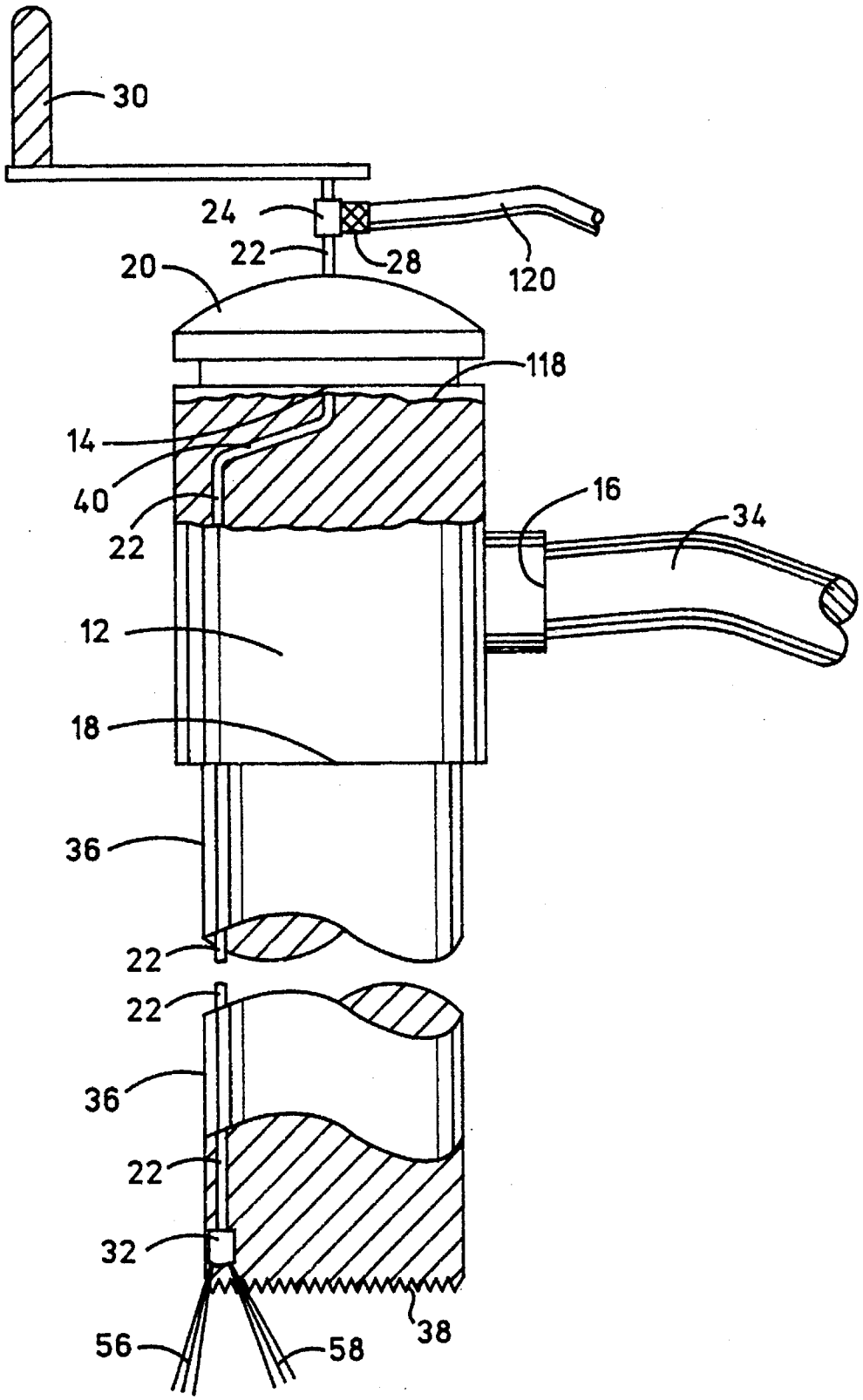
FIG. 2 is an elevation view with fragments broken away.

Turning now to FIG. 2, the drill 10 is shown in greater detail. The drill 10 has a T-tube 12 to provide a housing and an interconnection between the various parts of the drill 10. Typically, T-tube 12 is constructed of a suitable material, such as a metal or a hardened plastic. Two examples of these material are: bronze and PVC (poly vinyl chloride).

The first end 14 of T-tube 12 is connected to a cap 20. The cap 20 is the top end of the drill 10. The inner tube 22 extends through an opening (not shown) in the cap 20. In the preferred embodiment, a rotatable connection holds inner tube 22 secure within the opening. The cap 20 and inner tube 22 may be made from suitable materials, as mentioned above.

A swivel joint 24 is connected, at one end, to the top of inner tube 22. The other end of swivel joint 24 is connected to connector 28. The high pressure hose 120 mates with the connector 28. The high pressure hose 120 contains the flowable material that is discharged by nozzle 32. The high pressure hose 120 is connected to a pressure device. As mentioned above, the pressure device may be an air compressor, a water pump, or devices suitable to pressurize a flowable particulate solid, such as sand. Simply put, the pressurizing device is any device known in the art for pressurizing a flowable gas, liquid, or particulate solid. The pressure used to drill dirt, soil, or the like is preferably 100 psi, whereas the pressure used to drill sandstone and some cement mixtures is preferably 3000 to 20,000 psi.

A handle 30 is attached to the top of swivel joint 24 to allow the operator to rotate the inner tube 22. The rotation of inner tube 22 by means of the handle 30 also can be achieved by motorized means. Thus, it can be seen that a wide variety of devices not mentioned herein may be properly used to achieve the desired rotation of inner tube 22.

In an alternative embodiment, not shown in the drawings, inner tube 22 can be connected to outer tube 36 so that the handle 30 or the motorized rotational means can rotate outer tube 36 causing the inner tube 22 to also rotate.

The second end 16 of T-tube 12 is connected to the vacuum hose 34. Vacuum hose 34 is connected to a vacuum generator (not shown) for applying a sufficient suction to recover all the substance drilled, along with flowable material discharged by nozzle 32. Preferably, a vacuum pressure of ten inches of mercury (10" Hg) is used to recover dirt, soil, and the like when loosened by high pressure air. For dirt, soil, and the like loosened by water, a vacuum pressure of fifteen inches of mercury (15" Hg) is preferred. Finally, for dirt, soil, and the like loosened by a flowable particulate matter like sand, a vacuum pressure of twelve inches of mercury (12" Hg) is required. In applying a vacuum to the drill 10 by vacuum line 34, imperfections in the connection between the inner tube 22 and the cap 20 or in any other portion of the drill 10 can be tolerated. For example, a crack in the connected between the cap 20 and the inner tube 22 that could result in an opening for the drilled substance to escape is inconsequential because the constant negative pressure environment within drill 10 will prevent the escape of any of the drilled substance. This results because of the vacuum applied by vacuum hose 34.

The third end 18 of T-tube 12 is connected to the outer tube 36. The outer tube 36 extends a predetermined distance and terminates at grooves 38. The grooves 38 can be made sharp to drill soil that contains jagged rocks. If the drill 10 is used to drill soil that contains smooth rocks, such as those at the bottom of a river bed or a lake, the grooves 38 are preferably scalloped or smooth. Additionally, the grooves 38 can be made scalloped or smooth when the drill 10 is used to recover soil near a utility line in order to prevent a break of that utility line.

As shown in cut-away 118, the inner tube 22 is disposed within outer tube 36. At segment 40, inner tube 22 is bent so that the remainder of inner tube 22 below segment 40 is positioned near the inner surface of the outer tube 36. At the distal end of inner tube 22, relative to T-tube 12, inner tube 22 terminates at the connection to the nozzle 32.

The nozzle 32 is positioned at a location just above the grooves 38. The nozzle 32 discharges the flowable material in two jet streams, cutting jet 56 and agitating jet 58. During operation, when the drill 10 is rotating, cutting jet 56 remains aimed towards the grooves 38 on outer tube 36 that are closest to the emanation of cutting jet 56. Conversely, during rotation, the agitation jet 58 remains aimed towards the longitudinal axis of outer tube 36.

Figure 3:
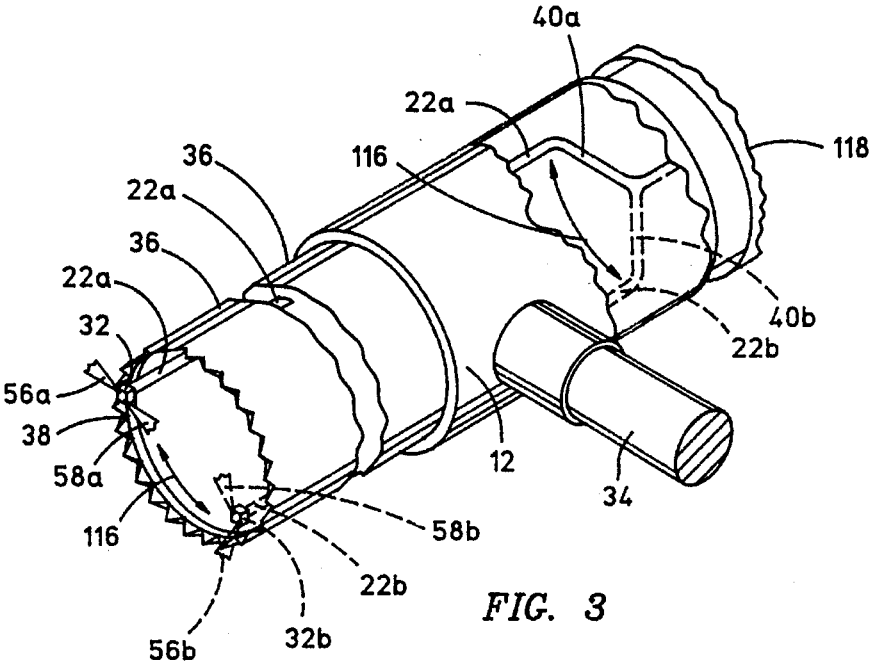
FIG. 3 is a partial isometric view of the present invention in operation with fragments broken away.

FIG. 3 is a perspective view of the drill 10 that demonstrates the action of the inner tube 22 and nozzle 32 during operation. As stated above, handle 30, or any other suitable rotation devices, such as a motor, is connected to the inner tube 22. In operation, the operator rotates the handle and, as a result, the inner tube 22 and nozzle 32 rotate. Thus, looking at FIG. 3, at an initial time (t=0), the nozzle 32*a*, inner tube 22*a*, and segment 40*a* have their illustrated positions. As the operator rotates handle 30, at some later time ($t=t_1$), the nozzle 32*b*, inner tube 32*b*, and segment 40*b* rotate along pathway 116 to be at a different location. In the preferred embodiment, the inner tube 22 and the nozzle 32 may rotate in either direction. In the alternative embodiment wherein the inner tube 22 is connected to outer tube 36, the operation is nearly identical; the only difference being that outer tube 36 rotates in unison with the inner tube 22.

Figure 4:
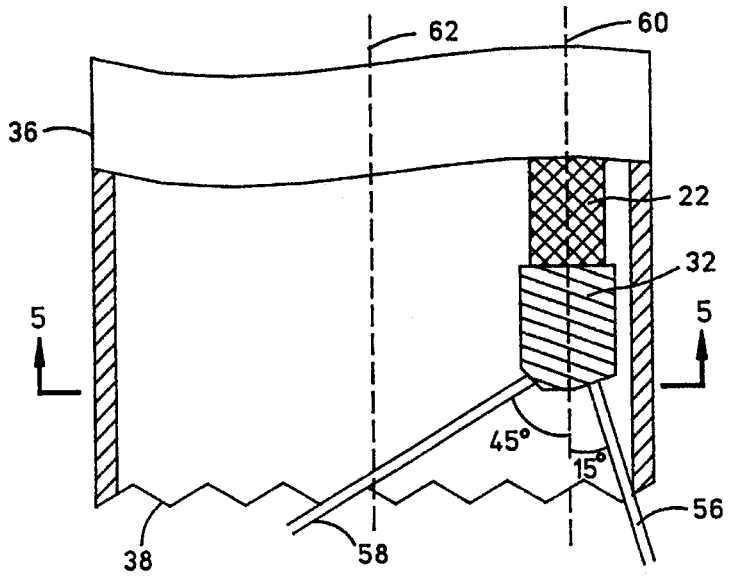
FIG. 4 is an partial elevation sectional view.

FIG. 4 is a more detailed illustration of the nozzle 32. The nozzle 32 has a longitudinal axis, denoted by the dotted line 60. Similarly, the outer tube 36 has a longitudinal axis, denoted by the dotted line 62. These two longitudinal axes are substantially parallel. As illustrated, the nozzle 32 discharges flowable material in a cutting jet 56 and an agitating jet 58. With regard to the cutting jet 56, the cutting jet 56 is offset from the longitudinal axis of both the nozzle 32 and the outer tube 36 in the range of 5 degrees to 40 degrees. The embodiment disclosed in FIG. 4 is offset by 15 degrees.

It is central to the present invention that the cutting jet 56 is a laminar flow. That is to say, the cutting jet 56 is a streamline flow of a fluid near a solid boundary. Specifically, the cutting jet 56 is aimed near a solid boundary, namely the grooves 38 of the outer tube 36. For proper operation, the distance between the exit of the cutting jet 56 from the nozzle 32 and the grooves 38 should be kept to a minimum. In theory, as the distance between the exit of the cutting jet 56 from the nozzle 32 and the grooves 38 increases, the turbulence associated with cutting jet 56 increases. Accordingly, as the turbulence associated with cutting jet 56 increases, the efficiency of cutting jet 56 decreases. That distance is preferably less than two inches (2") for air and less than twelve inches (12") for water.

FIG. 4 also illustrates the nozzle 32 discharging a second jet of flowable material, the agitating jet 58. The agitating jet 58 is aimed towards the longitudinal axis 62 of the outer tube 36. The agitating jet 58 serves to continually agitate the dirt, soil, or the like which was cut by the cutting jet 56. In keeping the material agitated, agitating jet 58 facilitates the recovery of the cut soil, dirt, and the like by the vacuum existing within outer tube 36.

In the operation of the illustrated embodiment, the nozzle 32 rotates around the inner circumference of the outer tube 36. Throughout this rotation, flowable material is being discharged from both cutting jet 56 and agitating jet 58. During this rotation, the cutting jet 56 remains aimed at the grooves 38 of outer tube 36 and the agitating jet 58 remains directed towards the longitudinal axis, dotted line 62, of the outer tube 36. As a result of the cutting jet 56 cutting the soil proximate to the grooves 38, the drill 10 advances further into the ground. As the drill advances into the ground, the loosened soil is urged further upwards in the outer tube 36. The action of agitating jet 58 maintains the soil in a loosened state so that the vacuum existing within outer tube 36 can remove the loosened soil. The operation of the alternative embodiment, wherein the inner tube 22 is connected to the outer tube 36 and the outer tube 36 is rotated, is identical to the preferred embodiment.

Figure 5:
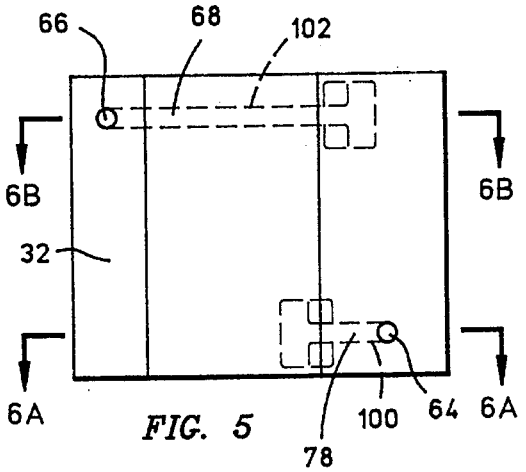
FIG. 5 is a bottom view of the nozzle along the line 5—5.

FIG. 5 shows a bottom view of the nozzle 32 taken along the line 5—5 in FIG. 4. The cutting jet 56 exits nozzle 32 at the cutting orifice 64. The dotted line 100 represents the interior pathway of cutting channel 78. The cutting channel 78 is the pathway that directs the flowable material out of cutting orifice 64. Similarly, the agitating jet 58 exits out of nozzle 32 at agitating orifice 66. The dotted line 102 represents the interior pathway of agitating channel 68. The agitating channel 68 is the pathway that directs the flowable material to its exit at agitating orifice 66. The diameter of each cutting orifice and the length of each cutting channel greatly affect the pressures that the flowable material exerts. The pressure exerted is directly related to the type of materials which may be drilled.

In a typical environment, there are factors that the operator must take into account when designing a nozzle and its orifices. First, the operator skilled in the art will be knowledgeable of the material to be drilled and will have decided what maximum surface area the drill will be removing. Based on the material which will be drilled and the surface area, the skilled operator will be aware of the required minimum pressure, P, necessary to cut that particular material. Should the flowable material be a liquid, the pressure P is typically measured in pounds per square inch gauge (PSIG) whereas when the flowable material is a gas, the pressure P is typically measured in pounds per square inch absolute (PSIA). From empirical experience, the operator skilled in the art will have determined the flow rate, Q, necessary to achieve the desired cutting. The flow rate, Q, is usually measured in gallons per minute (gpm) when the flowable material is a liquid, or cubic feet per minute (cfm) when the flowable material is a gas, such as air. Also, the skilled operator will be able to obtain the specific gravity of the flowable material, S, from a reliable reference. Finally, from a reliable reference, the operator skilled in the art will be knowledgeable of an orifice coefficient, Cd, associated with the orifice, when using a specific flowable material. Typically, the nozzle manufacturer will be able to provide the orifice coefficient. The orifice coefficient is empirically determined by applying to the nozzle varrying known pressures of the flowable material and measuring the various flow outputs at the orifice. Given these variables, an equation derived from a reference well known in the art, such as *Fluid Power Designers' Lightning Reference Handbook,* published by Paul-Munroe Hydraulics, Inc. (1982), can be used to determine the orifice diameter. For liquid flowable material, an equation, such as the one that follows, will determine the orifice diameter, d:

$$d=\sqrt{\frac{2}{29.81}\ \frac{Q}{Cd}\ \sqrt{\frac{S}{P}}}$$

where:

d=orifice diameter

Q=flow in gpm

Cd=orifice coefficient

S=specific gravity

P=pressure in PSIG

Similarly, for gaseous flowable material, the following equation will determine the orifice diameter, d:

$$d=\sqrt{\frac{Q}{14.5\,P\,Cd}}$$

where:

d=orifice diameter

Q=flow in gpm

Cd=orifice coefficient

P=pressure in PSIA

Based on the resultant orifice diameter, those skilled in the art will recognize that the channel length directing the flowable material to the orifice can be determined by a well known rule of thumb that the channel length should be no less than four times the value of the orifice diameter. As illustrated in FIG. 5, the cutting orifice 64 and the agitating orifice 66 are positioned on the nozzle 32 to accommodate the longest cutting channel 78 and the longest agitating channel 68 in the nozzle 32 with a minimized area.

Figure 6A:
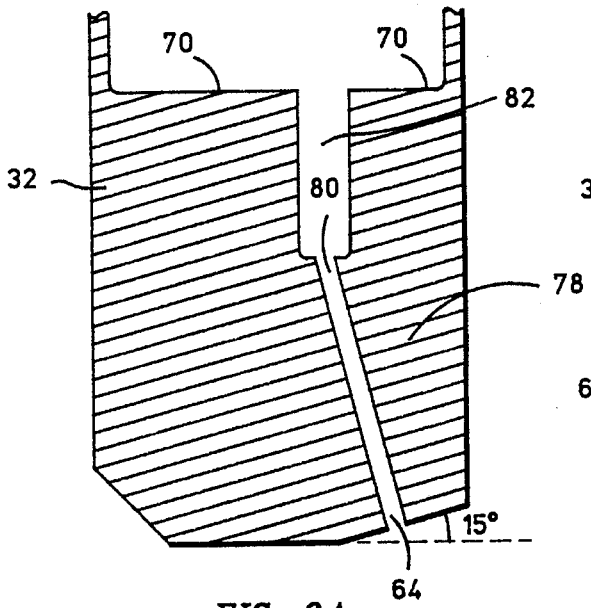
FIG. 6A is a section view of the nozzle along line 6A—6A.

FIG. 6A illustrates the cutting orifice 64 and the cutting channel 78 within the nozzle 32. In operation, the pressurized flowable material is forced into the nozzle 32 and against the interior surface 70. In FIG. 6A, some of the flowable material is forced into reservoir 82. The bottom of reservoir 82 is connected to the cutting channel 78 by the cutting channel entry 80. By providing the reservoir 82, as opposed to positioning the cutting channel entry 80 on the interior surface 70, the pressure exerted at cutting orifice 64 is normalized over time. Preferably, the cutting channel 78 has a length of at least four times the orifice diameter and is angled between 5 degrees and 40 degrees from the longitudinal axis of the inner tube 22 for proper operation. In the illustrated preferred embodiment, that angulation is 15 degrees.

Figure 6B:
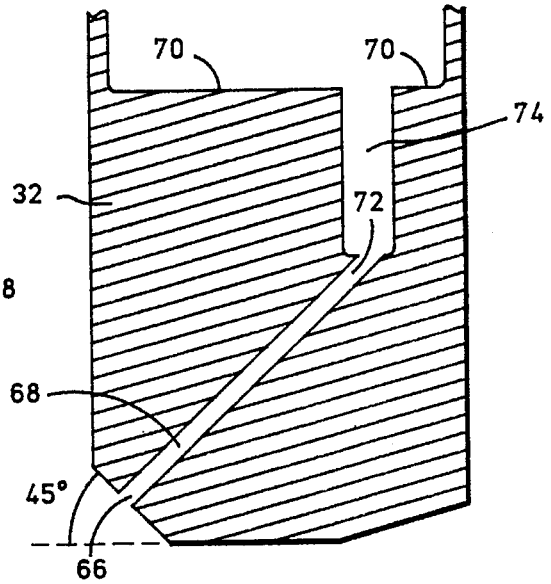
FIG. 6B is a section view of the nozzle along line 6B—6B.

FIG. 6B illustrates a different sectional view of nozzle 32. Specifically, FIG. 6B illustrates the agitating orifice 66 and the agitating channel 68 within the nozzle 32 along line 6B—6B in FIG. 5. In operation, as was similarly illustrated in FIG. 6A, the pressurized flowable material is forced into the nozzle 32 and against interior surface 70. In FIG. 6B, some of the flowable material is forced into the reservoir 74. The bottom of reservoir 74 is connected to the agitating channel 68 by the agitating channel entry 72. As was similarly stated above with regard to reservoir 82, by providing the reservoir 74, as opposed to positioning the agitating channel entry 72 on the interior surface 70, the pressure exerted at the agitating orifice 66 is normalized over time. In the preferred embodiment, the agitating channel 68 has a length of at least four times the orifice diameter. The agitating channel 68 may be angled between 40 degrees and 80 degrees from the longitudinal axis of the inner tube 22 for proper operation. In the illustrated preferred embodiment, that angulation is 45 degrees.

Figure 7:
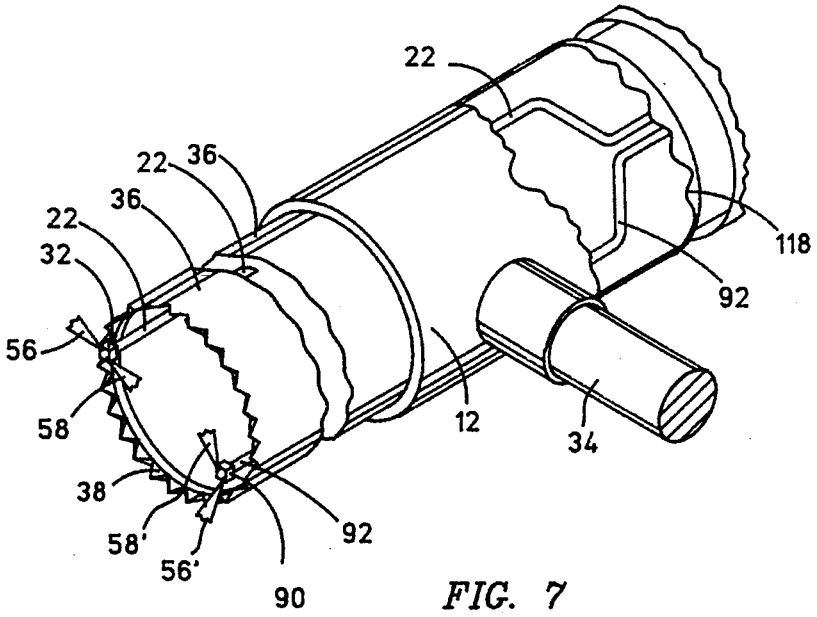
FIG. 7 is a partial isometric view of an alternative embodiment of the present invention.

FIG. 7 illustrates an alternative embodiment of the present invention. In this embodiment, the drill 10 includes a second nozzle 90 which is identical to that of the nozzle 32. The second nozzle 90 is connected to a second inner tube 92 which may be connected to the same pressure source or to a second pressure source (not shown). The second high pressure source need not be pressurizing the same type of flowable material as the first pressure source. For example, the first pressure source may be a air compressor and the second pressure source may be a water pump. Although not shown, the drill 10 may have more than two nozzles with more than two pressure sources discharging various combinations of three types of flowable materials discussed above, depending on the specific drilling requirements of the application.

Figure 8:
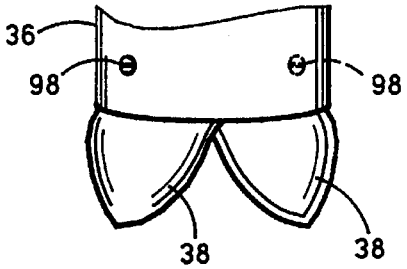
FIG. 8 is a partial elevation view.

FIG. 8 illustrates an alternative embodiment of the grooves 38 in the present invention. Specifically, grooves 38 may be selectively attached to the distal end of outer tube 36 by screws 98. Although the illustrated embodiments shows screws 98 to achieve the selective attachment, it is to be recognized that there are many identical methods for attaching the grooves 38, including, but not limited to, clamps, nuts and bolts, slots and tabs, and spring loaded posts. Thus, the selection of screws 98 is not intended to limit the scope of the drill.

The arrangement illustrated in FIG. 8 allows for the operator to switch the style of grooves 38 being used during the course of drilling operations, without having to change the entire drill 10 or the outer tube 36. Such a switch of the style of grooves 38 may be necessitated as the material being drilled changes during the course of drilling.

We claim:

1. An apparatus comprising:

a housing;

an outer tube having a distal end and a proximal end, said proximal end of said outer tube connected to said housing;

at least one inner tube having a distal end and a proximal end, said proximal end of said inner tube connected to said housing, said inner tube disposed within said outer tube;

at least one nozzle respectively connected to said distal end of said inner tube, said nozzle directed at the circumference of said distal end of said outer tube;

vacuum means connected to said housing;

at least one positive pressure means connected to said proximal end of said inner tube; and a plurality of grooves formed on said distal end of said outer tube.

2. An apparatus as recited in claim 1 wherein said nozzle has a first orifice and a second orifice, said first orifice directed at said distal end of said outer tube, said second orifice directed at the longitudinal axis of said outer tube.

3. An apparatus as recited in claim 2 wherein said first orifice is offset from the longitudinal axis of said inner tube by an angle of between 5 degree and 40 degrees, said second orifice is offset form the longitudinal axis of said inner tube by an angle of between 40 degrees and 80 degrees.

4. An apparatus as recited in claim 2 wherein said first orifice is offset from the longitudinal axis of said inner tube by an angle of 15 degrees, said second orifice is offset from the longitudinal axis of said inner tube by an angle of 45 degrees.

5. An apparatus as recited in claim 1 further comprising means for rotating said inner tube.

6. An apparatus as recited in claim 5 wherein said inner tube is attached to said outer tube.

7. An apparatus as recited in claim 1 wherein said pressure means pressurizes a flowable material.

8. An apparatus as recited in claim 7 wherein said flowable material is selected from the group consisting of a gas, a liquid, and a particulate solid.

9. An apparatus as recited in claim 1 wherein said plurality of grooves are selectively attachable to said distal end of said outer tube.

10. A drill for removing earthen material comprising:

a housing;

an outer tube connected to said housing;

at least one inner tube connected to said housing, said inner tube disposed within said outer tube;

means for connecting said inner tube to said outer tube;

at least one nozzle respectively connected to said inner tube at a distal end of said inner tube relative to said housing, said nozzle directed towards the circumference of a distal end of said outer tube relative to said housing;

an interior surface having a first entry orifice and a second entry orifice for receiving a flowable material;

a first exterior surface having a first discharge orifice for discharging said flowable material;

a second exterior surface having a second discharge orifice for discharging said flowable material;

a first channel being defined by a first pathway extending between said first entry orifice and said first discharge orifice;

a second channel being defined by a second pathway extending between said second entry orifice and said second discharge orifice;

vacuum means connected to said housing; and at least one positive pressure means connected to said inner tube at a proximal end of said inner tube relative to said housing.

11. A drill as recited in claim 10 wherein said first discharge orifice is directed at a distal end of said outer tube relative to said housing, said first discharge orifice being offset from the longitudinal axis of said inner tube by an angle of between 5 degrees and 40 degrees whereby said flowable material discharged through said first discharge orifice is discharged towards said distal end of said outer tube to cut said earthen material proximate to said distal end of said outer tube.

12. A drill as recited in claim 11 wherein said first discharge orifice is offset from the longitudinal axis of said inner tube by an angle of 15 degrees.

13. A drill as recited in claim 4 wherein said second discharge orifice is directed towards the longitudinal axis of said outer tube, said second discharge orifice is offset from the longitudinal axis of said inner tube by an angle of between 40 degrees and 80 degrees.

14. A drill as recited in claim 13 wherein said second discharge orifice is offset from the longitudinal axis of said inner tube by an angle of 45 degrees.

15. A drill as recited in claim 13 further comprising a plurality of grooves formed on the distal end of said outer tube, the distal end being distal relative to said housing.

16. A drill as recited in claim 13 further comprising a plurality of grooves selectively attached at the distal end of said outer tube, the distal end being distal relative to said housing.

17. An apparatus comprising:

a housing;

an outer tube having a distal end and a proximal end, said proximal end of said outer tube connected to said housing;

a plurality of inner tubes respectively having a distal end and a proximal end, said proximal ends of said plurality of inner tubes connected to said housing, said plurality of inner tubes disposed within said outer tube;

a plurality of nozzles respectively connected to said distal ends of said plurality of inner tubes;

vacuum means connected to said housing; and at least one positive pressure means respectively connected to at least one of said proximal ends of said plurality of inner tubes, said positive pressure means pressurizing a flowable material selected from the group consisting of a gas, a liquid, and a particulate solid.

18. An apparatus as recited in claim 17 wherein said distal end of said outer tube further comprises a plurality of grooves.

19. An apparatus as recited in claim 18 wherein said plurality of grooves are selectively attachable to said distal end of said outer tube.

20. A drill for removing earthen material comprising:

a housing;

an outer tube connected to said housing;

a plurality of inner tubes connected to said housing, said plurality of inner tubes disposed within said outer tube;

means for connecting said plurality of inner tubes to said outer tube;

a plurality of nozzles respectively connected to said plurality of inner tubes at a distal end of said plurality of inner tubes relative to said housing, each of said plurality of nozzles further comprising:

an interior surface having a first entry orifice and a second entry orifice for receiving a flowable material;

a first exterior surface having a first discharge orifice for discharging said flowable material, said first discharge orifice being directed at a distal end of said outer tube relative to said housing, said first discharge orifice being offset from the longitudinal axis of said inner tube by an angle of between 5 degrees and 40 degrees;

a second exterior surface having a second discharge orifice for discharging said flowable material, said second discharge orifice being directed towards the longitudinal axis of said outer tube, said second discharge orifice is offset from the longitudinal axis of said inner tube by an angle of between 40 degrees and 80 degrees;

a first channel being defined by a first pathway extending between said first entry orifice and said first discharge orifice; and a second channel being defined by a second pathway extending between said second entry orifice and said second discharge orifice;

vacuum means connected to said housing; and at least one positive pressure means connected to said plurality of inner tubes at a proximal end of said plurality of inner tubes relative to said housing.

21. A drill as recited in claim 20 further comprising means for rotating said outer tube.

22. A drill as recited in claim 20 wherein said means for connecting said plurality of inner tubes to said outer tube comprises means for rotating said plurality of inner tubes within said outer tube.

23. A drill as recited in claim 20 wherein said flowable material is selected from the group consisting of a gas, a liquid, and a particulate solid.

24. A drill as recited in claim 20 further comprising a plurality of grooves formed on the distal end of said outer tube, the distal end being distal relative to said housing.

25. A drill as recited in claim 20 further comprising a plurality of grooves selectively attached at the distal end of said outer tube, the distal end being distal relative to said housing.

* * * * *